United States Patent [19]

Beauchamp

[11] Patent Number: 4,819,286

[45] Date of Patent: Apr. 11, 1989

[54] STIFFENER FOR DRY FLOTATION CUSHIONS USED IN WHEELCHAIRS

[76] Inventor: David J. Beauchamp, 2814 E. 20th, Tucson, Ariz. 85716

[21] Appl. No.: 158,787

[22] Filed: Feb. 22, 1988

[51] Int. Cl.[4] ..... A47C 7/00; A47C 7/62

[52] U.S. Cl. ..... 5/431; 5/447; 5/448; 5/462; 297/193; 297/DIG. 4

[58] Field of Search ..... 5/448, 431, 462, 446, 5/447, 81 R, 61, 436, 440; 297/193, 42, 455, DIG. 4, DIG. 2

[56] References Cited

U.S. PATENT DOCUMENTS

| | | | |
|---|---|---|---|
| 2,047,616 | 7/1936 | Church | 155/179 |
| 3,222,694 | 12/1965 | Schick | 5/431 |
| 3,261,031 | 7/1966 | Gates | 5/86 |
| 4,065,179 | 12/1977 | Takasaki | 297/384 |
| 4,101,143 | 7/1978 | Sieber | 297/DIG. 4 |
| 4,222,138 | 9/1980 | Rowley | 5/448 |
| 4,474,407 | 10/1984 | Nazar | 297/192 |
| 4,522,447 | 6/1985 | Snyder et al. | 297/DIG. 1 |
| 4,556,250 | 12/1985 | Chapman et al. | 297/192 |
| 4,643,481 | 2/1987 | Saloff et al. | 297/458 |
| 4,646,374 | 3/1987 | Shafer | 5/431 |
| 4,682,818 | 7/1987 | Morell | 5/437 |

*Primary Examiner*—Gary L. Smith
*Assistant Examiner*—Michael Milano
*Attorney, Agent, or Firm*—Victor Flores

[57] ABSTRACT

A stiffener and support structure for dry flotation cushions used on wheelchairs and a method for supporting dry flotation cushions used in wheelchairs. The structure includes a substantially rectangular rigid plate for inserting into the fabric covering of a dry flotation cushion for improving the support provided by a plurality of dry flotation cells when the dry flotation cushion is supported on the side frame members of a wheelchair. The rigid support plate has chamfered corners and is preferably manufactured of clear, molded plastic. The support plate is also provided with a void on the frontward section to allow formation of a pouch-like storage area by the wheelchair occupant using the support plate in a dry flotation cushion.

10 Claims, 1 Drawing Sheet

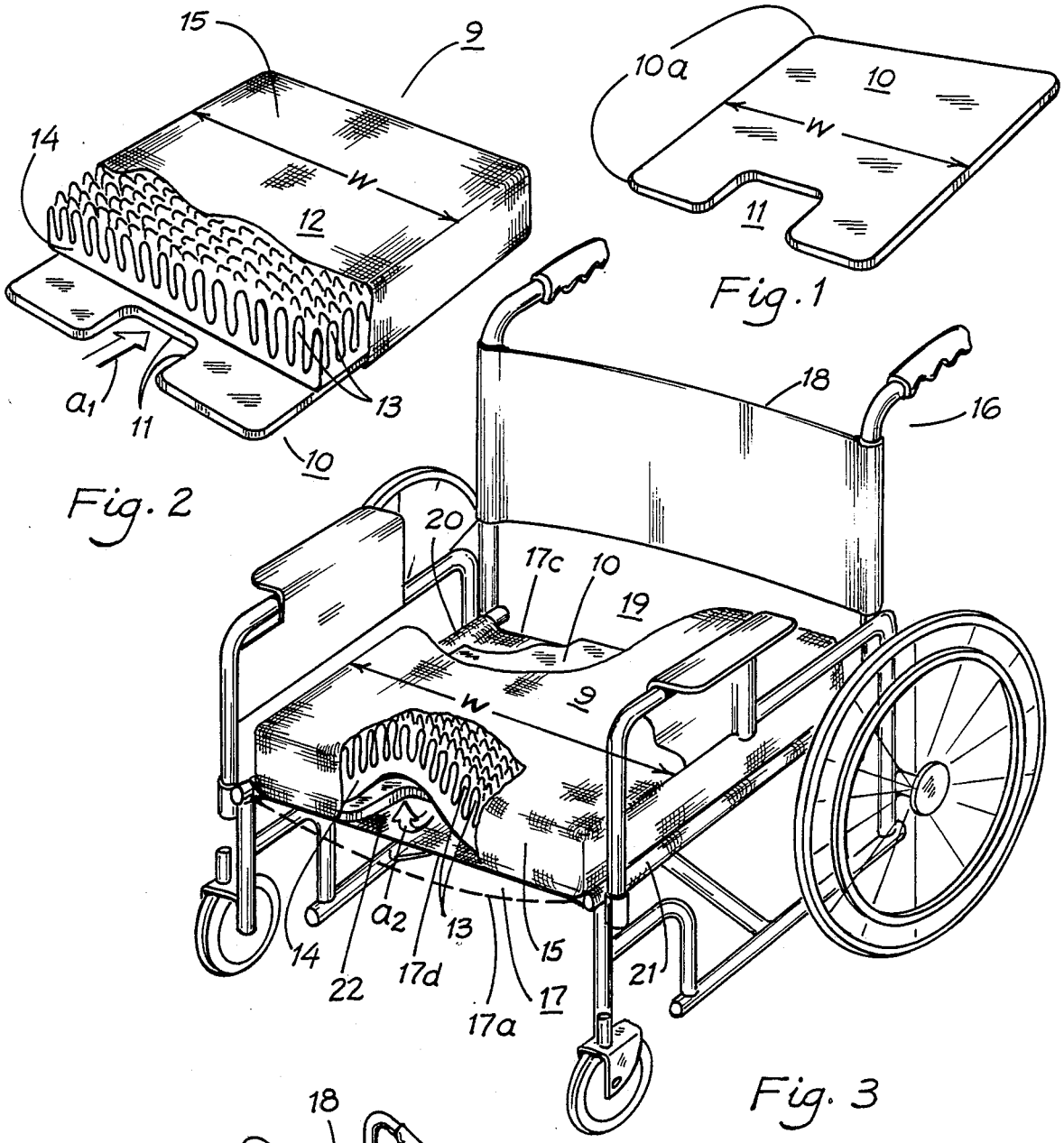
Fig. 1
Fig. 2
Fig. 3
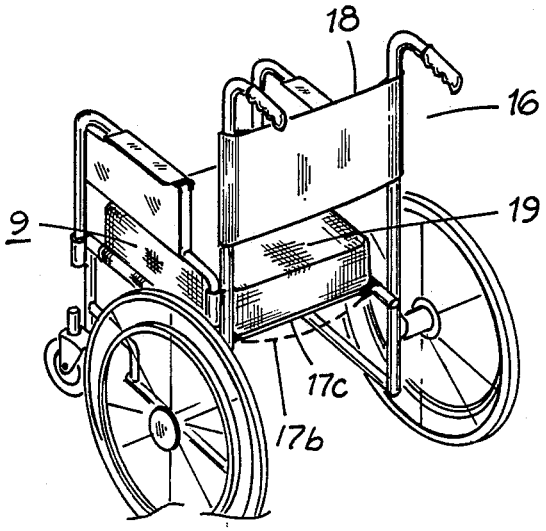
Fig. 4

STIFFENER FOR DRY FLOTATION CUSHIONS USED IN WHEELCHAIRS

FIELD OF THE INVENTION

The present invention generally relates to seat cushion supports and, more particularly, is concerned with apparatus and method for seat cushion supports for wheelchairs providing rigidity for cushions placed on the fabric seat of foldable wheelchairs and providing storage of small personal items beneath the seat cushion.

DESCRIPTION OF THE PRIOR ART

The problem of providing comfortable, healthful, and convenient long term seating has long been recognized. There have been a variety of approaches to the problem, many of which are designed for wheelchair occupants. One method is to provide cushioning material which distributes the weight of the seated person. The weight may be distributed more or less equally on the seat and lower thighs or may be concentrated on the seat.

A further problem for seated individuals is the storage of small personal items where they are easily accessible and do not interfere with movement of the individual or use of the chair. One method is to provide storage area under the seat where there is no spatial interference with the use of the chair.

Many modern wheelchairs are collapsible in order to be transportable. Most such chairs have suspended fabric seats and backs to facilitate reversible side-to-side folding of the chair. Seat cushioning for these chairs is provided as removable cushion sections of various materials. Dry or air flotation cushions are commonly used, including one manufactured by ROHO Research and Development, Inc.

Since any cushioning material assumes the surface shape of its support to some extent, the cushion assumes the concave surface shape of the suspended fabric seat in portable wheelchairs. No effort has been made to provide for desirable equitable lateral distribution of the seated weight of the chair occupant.

Storage of personal items in and about the fabric seat of a collapsible wheelchair is also a problem because of the requirements for flexbile materials and the removal of the cushion.

One method of providing cushioned distribution of seated weight is described and illustrated in U.S. Pat. No. 2,047,616. A cellular cushion is supported on a fixed, contoured plate having a substantially horizontal rear section, an upwardly sloping central section, and a substantially horizontal forward section. The depth of the cushion at the front edge is much less than the depth in the rear areas to provide more cushioning material where the seated occupant's weight is the greatest. The rigidly formed space beneath the forward section of the seat may be used as a storage compartment accessed through a forward door.

U.S. Pat. No. 3,261,031 describes and illustrates a patient handler, a wheelchair which includes a handled seat portion which can be removed from the top front section of the seat of the patient handler when the chair is to be used as a toilet seat. The chair sections are hingeably collapsible to the horizontal position to allow a patient to be moved from a reclining position to a seated position. No side-to-side adjustment of the chair sections are provided.

A method of temporary storage of articles within the seat of a portable, foldable chair is described and illustrated in U.S. Pat. No. 4,474,407. Access to the storage compartment is provided through a front access panel. The rigid seat and back sections of the chair are hingeably foldable for transportation but no sideto-side adjustment of the chair sections is provided.

Another method for storage of personal items around the seat portion of fixed stadium-style seating is described and illustrated in U.S. Pat. No. 4,556,250. A rigid frame apparatus is temporarily attached to the seat to provide storage beneath the seat and a slidable shelf beyond the front edge of the seat. Prior art teaches the use of seat cushions for use on the fabric seat of wheelchairs, the prior art also teaches the use of dry flotation cushions which conform to the occupants seated body and to the concave shape of the fabric seat provided on wheelchairs, however, the prior artr does not teach a means for making the dry flotation cushions more rigid and thus eliminate total conformity to the concave fabric seat and associated discomfort to occupant. The prior art does not teach a means for providing a storage area when using dry flotation cushions on wheelchairs which will adequately storage personal items. Therefore, a need exists to provide a means for stiffening and supporting wheelchair seat cushions, in particular dry flotation seat cushions and to provide an easily accessible storage meeting the special problems presented by collapsible wheelchairs and occupants.

SUMMARY OF THE INVENTION

The present invention provides a method and apparatus for improving seat cushion support provided by dry rotation cushions used by occupants of wheelchairs. The apparatus is designed to provide a pouch-like storage area between the stiffened cushion and the fabric seat of the wheelchair for easily accessible storage of personal items by the occupant of the wheelchair. The apparatus consists of a rigid plate structure adapted to the width of the wheelchair seat which slips into the fabric cover of wheelchair seat cushions beneath the plurality of flotation cells typically provided on dry flotation cushions, (such as the air cushion manufactured by ROHO Research and Developemnt, Inc 3105 Missouri, E. St. Louis, IL 62205). The pouch-like storage area is formed in the forward portion of the wheelchair by providing a flexible portion on the stiffened dry flotation cushion. The flexible portion is provided by designing a void portion on a frontward section of the rigid plate structure such that the similarly located flotation cells remain unsupported and can be lifted by the occupant to store personal items. The method consists of series of steps for stiffening a dry flotation cushion by providng an apparatus which slips into the fabric cover of seat cushions to provide rigid support and is supported on the side seat support members of a wheelchair. The method further consists of storing small items between the fabric seat of collapsible wheelchairs and a removable seat cushion within the space created by a cutout in the seat support and the space created by vertical deformation of the seat cushion.

Therefore, to the accomplishments of the foregoing objects, the invention consists of the foregoing features hereinafter fully described and particularly pointed out in the claims, the accompanying drawings and following disclosure describing in detail the invention, such drawings and disclosure illustrating, however, but one of the various ways in which the invention may be practiced.

BRIEF DESCRIPTION OF THE DRAWINGS

FIG. 1 is a perspective view of the cushion stiffener of the present invention.

FIG. 2 is a perspective view of the present invention partially inserted into the fabric cover of a typical dry flotation seat cushion with the flotation cells shown in partial cut away.

FIG. 3 is a frontal perspective view of the cushion stiffener of the present invention inserted in a partially cut away seat cushion and supported by the side frame members of a collapsible wheelchair and also showing an auxiliary pouch-like storage area formed between the wheelchair fabric seat and the stiffened dry flotation cushion.

FIG. 4 is a rear perspective view of the cushion stiffener of the present invention inserted in a seat cushion and supported by the side frame members of a collapsible wheelchair, showing the improved support achieved by the present invention.

DESCRIPTION OF THE PREFERRED EMBODIMENT

Referring now to the drawings, and more particularly to FIG. 1, there is shown a substantially rigid seat cushion support, generally designated 10, which comprises the preferred embodiment of the present invention. Seat cushion support 10 is of a substantially rectangular shape, has front cutout 11, has chamfered corners 10a, and is preferably manufactured of clear, molded plastic.

FIG. 2 shows an air flotation cushion used on wheelchairs having partially inserted seat cushion support and generally designated 9. Air flotation cushion 12 has a plurality of air pockets, or flotation cells 13 with base air reservoir 14 and fabric cover 15. Seat cushion support 10 is shown partially inserted in the direction of arrow a1 into fabric cover 15 between the fabric cover 15 and the plurality of flotation cells 13. The direction of installation depends on the means provided on the dry flotation cushion for accessing the dry flotation cells.

FIGS. 3 and 4 show seat cushion support 10 fully inserted into fabric cover 15 to create a stiffened air flotation cushion 9 and placed in wheelchair 16. Wheelchair 16 has collapsible fabric seat back 18, collapsible fabric seat, generally designated 17, and back opening 19. Collapsible fabric seat 17 is comprised of sagging front **17*a* and sagging back 17*b*. The sagging portions 17*a* and 17*b* are generally conformed to by a unsupported cushion 12 and leads to an uncomfortable situation solved by a supported cushion 9. The unsupported cushion 12 also has a tendency to work its way from seat 17 towards the back opening 19. Wheelchair 16 has left seat cushion support frame member 20 and right seat cushion support frame member 21. Seat cushion support 10 and air flotation cushion 12 have preselected width w adapted to be supported by left and right seat cushion support frame members 20 and 21 having a corresponding width w when wheelchair 16 is fully expanded. When stiffened dry flotation cushion 9 is positioned over a fabric seat 17 the support offered an occupant is improved by the resulting ridid base provided by support 10 as well as the resulting stiffening action on fabric seat 17, see generally non-sagging front fabric 17*d* and non-sagging rear fabric 17*c*. Also when stiffened dry flotation cushion 9 is position on wheelchair 16 an occupant can form a pouch-like storage area 22 by lifting air flotation cushion 9 in the direction of arrow a2**. This pouch-like storage area can be used by the occupant to store a coin purse, billfold, keys or other personal items.

Therefore, while the present invention has been shown and described herein in what is believed to be the most practical and preferred embodiment, it is recognized that departures can be made therefrom within the scope of the invention, which is therefore not to be limited to the details disclosed herein but is to be accorded the full scope of the claims so as to embrace any and all equivalent apparatus.

I claim:

1. A stiffener and support structure for improving the seating support provided by dry flotation cushions used on wheelchairs, said stiffener and support structure comprising:

(a) a substantially rectangular rigid plate having a frontward section and a rearward section, said plate being adapted for positioning within a fabric covering and beneath a plurality of flotation cells provided on said dry floatation cushions for stiffening and improving seating support of said dry flotation cushions; and (b) said frontward section provided with a void for maintaining a portion of said plurality of flotation cells frontwardly located in a loose and unsupported state.

2. A stiffener and support structure for improving the seating support provided by dry flotation cushions used on wheelchairs as recited in claim 1, wherein:

said substantially rectangular rigid plate is further adapted to fit in approximate registration with side frame members of a wheelchair.

3. A stiffener and support structure for improving the seating support provided by dry flotation cushions used on wheelchairs as recited in claim 1, wherein:

said substantially rectangular rigid plate is manufactured from a clear, molded plastic and is designed to have chamfered corners.

4. A stiffener and support structure for improving the seating support provided by dry flotation cushions used on wheelchairs as recited in claim 1, wherein:

said void provided on said frontward section has a substantially rectangular shape.

5. A stiffened and rigidly supported dry flotation cushion apparatus for use on wheelchairs, said apparatus comprising:

(a) a dry flotation cushion having a fabric cover enclosing a plurality of flotation cells; and (b) a substantialy rectangular rigid plate positioned within said fabric covering, said substantially rectangular rigid plate having a frontward section and a rearward section, said substantially rectangular rigid plate being adapted for positioning within said fabric cover, beneath said plurality of flotation cells for stiffening and improving seating support of said dry flotation cushion, said frontward section being provided with a substantially rectangular shaped void for maintaining a frontwardy located portion of said plurality of flotation cells in a loose and unsupported state to allow formation of a pouch-like storage area between a frontward bottom portion of said dry flotation cushion and a seat portion of said wheelchair and said substantially rectangular rigid plate being adapted to have a width to fit in approximate registration with side frame members of a wheelchair.

6. A stiffened and rigidly supported dry flotation cushion apparatus for use on wheelchairs as recited in claim 5, wherein:

said substantially rectangular rigid plate is manufactured from a clear, molded plastic and is designed to have chamfered corners.

7. A method for improving support provided by dry flotation cushions used in wheelchairs, said method comprising the steps of:

(a) providing a stiffener and support structure;

(b) providing a dry flotation cushion, said dry flotation cushion having a fabric cover and a plurality of flotation cells;

(c) slipping said stiffener support structure into said fabric cover beneath said plurality of said flotation cells;

(d) providing a wheelchair having side frame support member and a fabric seat fixedly attached between each of said side frame support members;

(e) supporting said stiffener support structure within said fabric cover of said air flotation cushion on each of said side frame support members of said wheelchair; and (f) providing a pouch-like storage area in a frontwardly located portion of said wheelchair between said supported dry flotation cushion and said fabric seat for storing of small items by occupant of said wheelchair.

8. A method for improving support provided by dry flotation cushions used in wheelchairs, as recited in claim 7, wherein said step of providing a stiffener support structure includes:

providing a substantially rectangular rigid plate for positioning within said fabric covering, said substantially rectangular rigid plate having a frontward section and a rearward section, said substantially rectagnular rigid plate being adapted for positioning within said fabric cover, beneath said plurality of flotation cells for stiffening and improving seating support of said dry flotation cushion and said substantially rectangular rigid plate being adapted to have a width to fit in approximate registration with side frame members of a wheelchair.

9. A method for improving support provided by dry flotation cushions used in wheelchairs, as recited in claim 8, wherein said step of providing a stiffener support structure further includes:

providing said substantially rectangular rigid plate manufactured from a clear, molded plastic and designed to have chamfered corners.

10. A method for improving support provided by dry flotation cushions used in wheelchairs, as recited in claim 8, wherein said step of providing a pouch-like storage area includes: providing said frontward section with a substantially rectangular shaped void for maintaining a frontwardly located portion of said plurality of flotation cells in a loose and unsupported state to allow formation of said pouch-like storage area between a frontward bottom portion of said dry flotation cushion and said seat fabric of said wheelchair.

* * * * *